US008516825B2

(12) United States Patent
Haffner et al.

(10) Patent No.: US 8,516,825 B2
(45) Date of Patent: Aug. 27, 2013

(54) METHOD FOR REDUCING THE NOX EMISSIONS FROM A BURNER ARRANGEMENT COMPRISING A PLURALITY OF BURNERS, AND BURNER ARRANGEMENT FOR CARRYING OUT THE METHOD

(75) Inventors: Ken-Yves Haffner, Baden (CH); Douglas Pennell, Freienwil (CH); Christian Steinbach, Birmenstorf (CH)

(73) Assignee: Alstom Technology Ltd, Baden (CH)

( * ) Notice: Subject to any disclaimer, the term of this patent is extended or adjusted under 35 U.S.C. 154(b) by 718 days.

(21) Appl. No.: 11/337,499

(22) Filed: Jan. 24, 2006

(65) Prior Publication Data

US 2006/0144049 A1 Jul. 6, 2006

Related U.S. Application Data

(63) Continuation of application No. PCT/EP2004/051483, filed on Jul. 14, 2004.

(30) Foreign Application Priority Data

Jul. 24, 2003 (DE) ..... 103 33 671

(51) Int. Cl.
*F02C 9/00* (2006.01)

(52) U.S. Cl.
USPC ..... 60/773

(58) Field of Classification Search
USPC ..... 60/39.281, 242, 772, 773, 734, 739
See application file for complete search history.

(56) References Cited

U.S. PATENT DOCUMENTS

| | | | | |
|---|---|---|---|---|
| 2,757,961 | A * | 8/1956 | Nims | 60/39.281 |
| 3,712,055 | A * | 1/1973 | McCabe | 60/39.281 |
| 4,590,768 | A * | 5/1986 | Halvorsen et al. | 60/739 |
| 4,609,150 | A * | 9/1986 | Pane et al. | 239/397.5 |

(Continued)

FOREIGN PATENT DOCUMENTS

| | | |
|---|---|---|
| EP | 0 529 900 B1 | 3/1993 |
| EP | 0 807 787 A2 | 11/1997 |

(Continued)

OTHER PUBLICATIONS

International Search Report dated Nov. 25, 2004.

(Continued)

*Primary Examiner* — Gerald L Sung
(74) *Attorney, Agent, or Firm* — Buchanan Ingersoll & Rooney PC

(57) ABSTRACT

In a method for reducing the NOx emissions from a burner arrangement comprising a plurality of burners (B1, . . . , Bn), in particular in a gas turbine, which burners (B1, . . . , Bn) are operated in parallel and each burner supplied fuel by means of combustion air to form a flame (F1, . . . , Fn), an effective drop is achieved in a simple way by virtue of the fact that at a predetermined time the flame temperatures of individual burners (B1, . . . , Bn) or burner groups or differences between the flame temperatures of individual burners (B1, . . . , Bn) or burner groups are measured directly or indirectly. The fuel supply to those burners or burner groups whose flame temperature exceeds a predetermined value for the flame temperature is selectively throttled in order to homogenize the flame temperatures of the burners (B1, . . . , Bn).

8 Claims, 3 Drawing Sheets

(56) References Cited

U.S. PATENT DOCUMENTS

| | | | | |
|---|---|---|---|---|
| 5,327,718 | A * | 7/1994 | Iwata et al. | 60/773 |
| 5,423,175 | A | 6/1995 | Beebe et al. | |
| 6,293,105 | B1 * | 9/2001 | Claesson et al. | 60/748 |
| 2002/0178730 | A1 * | 12/2002 | Ganz et al. | 60/773 |
| 2004/0161715 | A1 | 8/2004 | Schlicker et al. | |
| 2005/0247066 | A1 * | 11/2005 | Myhre | 60/803 |

FOREIGN PATENT DOCUMENTS

| | | | |
|---|---|---|---|
| EP | 0 969 192 | B1 | 1/2000 |
| EP | 1 217 300 | A1 | 6/2002 |
| EP | 1 273 776 | A1 | 1/2003 |
| EP | 1 288 467 | A1 | 3/2003 |
| JP | 10-317991 | A2 | 12/1998 |

OTHER PUBLICATIONS

International Preliminary Examination Report dated Jul. 24, 2003.

* cited by examiner

METHOD FOR REDUCING THE NOX EMISSIONS FROM A BURNER ARRANGEMENT COMPRISING A PLURALITY OF BURNERS, AND BURNER ARRANGEMENT FOR CARRYING OUT THE METHOD

RELATED APPLICATION

The present application is a continuation application which claims the benefit of the filing date under 35 USC §120 of PCT/EP2004/051483, filed Jul. 14, 2004, and the priority of German Application No. 103 33 671.0, filed Jul. 24, 2003, the contents of which are hereby incorporated by reference in their entireties.

FIELD OF THE INVENTION

The present invention deals with the field of combustion technology. It relates to a method for reducing the NOx emissions and to a burner arrangement for carrying out the method.

BACKGROUND OF THE INVENTION

Over the course of the last decade, the NOx emissions from gas turbine power plants have been lowered by a factor of 10 by means of lean-premix combustion. This is achieved in particular by virtue of the fact that the temperatures in the reaction zone of the combustion chamber (flame temperature) have been significantly lowered. A large number of burners which operate in parallel and generate the hot gas required for the turbine to operate are generally arranged in the combustion chambers of gas turbines (cf. for example EP-A1 1 273 776). A drawback in this context with regard to the NOx emissions is that on account of tolerances in burner and combustion chamber manufacture, not all the burners are operated at their optimum, low-pollutant operating point. Rather, there is a considerable variation in the flame temperature. As a result, the potential for lowering the emissions of NOx offered by the lean-premix burners can be only partially exploited.

JP-A2 10317991 has proposed that in a gas turbine having a plurality of premix burners the quantity of NOx be reduced, and at the same time the combustion be stabilized in the event of a load change in the turbine, by the temperatures of the flame stabilizers, of the combustion chamber lining and of the hot gases being measured, and the operating state of the burners being derived from this information. The fuel supply to the burners is then controlled on the basis of the measurement results in such a way that the combustion is stabilized with regard to partial misfires and deviations in the supplied fuel quantity. The objective in this context is to (dynamically) stabilize the combustion in the event of load changes in the gas turbine. At the same time, this prevents a rise in the quantity of NOx caused by the occurrence of burner instability.

The above cannot be used to permanently compensate for tolerances in the burner and combustion chamber configuration.

EP-A1 0 529 900 has disclosed a gas turbine and a method for controlling it in which the flow of fuel to a plurality of burners is controlled individually by means of corresponding control devices taking account of a predetermined combustion characteristic in accordance with specific temperature values recorded in the combustion chamber. Control of this type is highly complex and is susceptible to instabilities relating to control engineering.

EP-A1 0 969 192 has disclosed a method for equalizing the fuel distribution system in gas turbines having a plurality of burners, in which inhomogeneities in the fuel distribution system are equalized by the targeted alteration of the fuel mass flows by means of throttling members. To do this, certain pressure differences in the system are measured. This does not allow direct optimization of the flame temperatures.

SUMMARY OF THE INVENTION

It is an object of the invention to provide a method by which design-related and manufacturing-related inhomogeneities in the flame temperatures of a burner arrangement can be compensated for in a simple way, and as a result the additional NOx emissions associated with the inhomogeneities can be permanently lowered, and to provide a burner arrangement for carrying out the method.

The core concept of the invention consists in directly or indirectly measuring the flame temperatures of the individual burners or burner groups and then permanently throttling the fuel supply to those burners or burner groups whose flame temperatures are above a predetermined value, in order to compensate for the deviations in these burners caused by design engineering and manufacturing technology. This operation can be carried out one or more times and then leads to long-term homogenization of the flame temperatures and, as a corollary measure, to a reduction in the NOx emissions caused by the inhomogeneities.

A preferred configuration of the method according to the invention is distinguished by the fact that the individual burners or burner groups are each supplied with fuel via a fuel feedline, and that the throttling of the fuel supply is carried out by means of a throttling member arranged in the fuel feedline. This results in particularly simple adapting of the various burners with a view to homogenizing the flame temperature.

One possible way of measuring the flame temperatures consists in the measurement of the flame temperatures being carried out directly at the flames, with the measurement of the flame temperatures being carried out in particular by an optical route.

One possible way of measuring the flame temperatures consists in the measurement of the flame temperatures being carried out by an indirect route, in which case in particular the flame generated in a combustion chamber, and to measure the flame temperatures the temperatures of selected parts or regions of the combustion chamber are measured, or alternatively the hot gases generated in the flames by the burners are passed through a utilization device, in particular a gas turbine, and to measure the flame temperatures of burners or burner groups, the temperatures at the outlet of the utilization device are measured. Indirect measurement of the flame temperature is significantly simpler to realize and carry out in metrological terms.

To permanently throttle the fuel supply, it is preferable to use a settable throttling member, which may optionally be a settable valve, an adjustable throttling screw or an exchangeable diaphragm with a predetermined diaphragm opening.

One preferred configuration of the burner arrangement according to the invention is characterized in that the first means comprise a plurality of sensors which are connected to a measuring unit, with the sensors being designed either for direct measurement of the flame temperature, preferably by an optical route.

Alternatively, the sensors are designed to measure the temperature of components, the burners are accommodated in one or more combustion chambers and the sensors are arranged distributed in or on the combustion chamber(s).

As a further alternative to this, a utilization device for the hot gases, in particular in the form of a gas turbine, is arranged downstream of the burner arrangement, and the sensors are designed to measure the temperature of hot gases, and the sensors are arranged at the outlet of the utilization device.

BRIEF DESCRIPTION OF THE DRAWINGS

The invention is to be explained in more detail below on the basis of exemplary embodiments in conjunction with the drawing, in which.

DETAILED DESCRIPTION

The content of the present invention inter alia involves identifying the hottest burners of gas turbines having a plurality of burners or burner groups by direct or indirect measurement of the flame temperature or of the differences in the flame temperature. This measurement can be carried out in various ways (for example by measuring the temperature downstream of the turbine, by measuring the material temperature of parts of the combustion chamber, by direct optical measurement of the flame temperature).

After the flame temperature has been measured, the flame temperatures are homogenized by throttling the fuel supply to the burners with an excessively high flame temperature. This throttling can be effected by means of settable valves, settable throttling screws or fixedly installed throttling members (e.g. diaphragms). The operation of flame temperature measurement and throttling of the burners with an accessibly high flame temperature can be repeated until the desired homogeneity is achieved.

Figure 1:
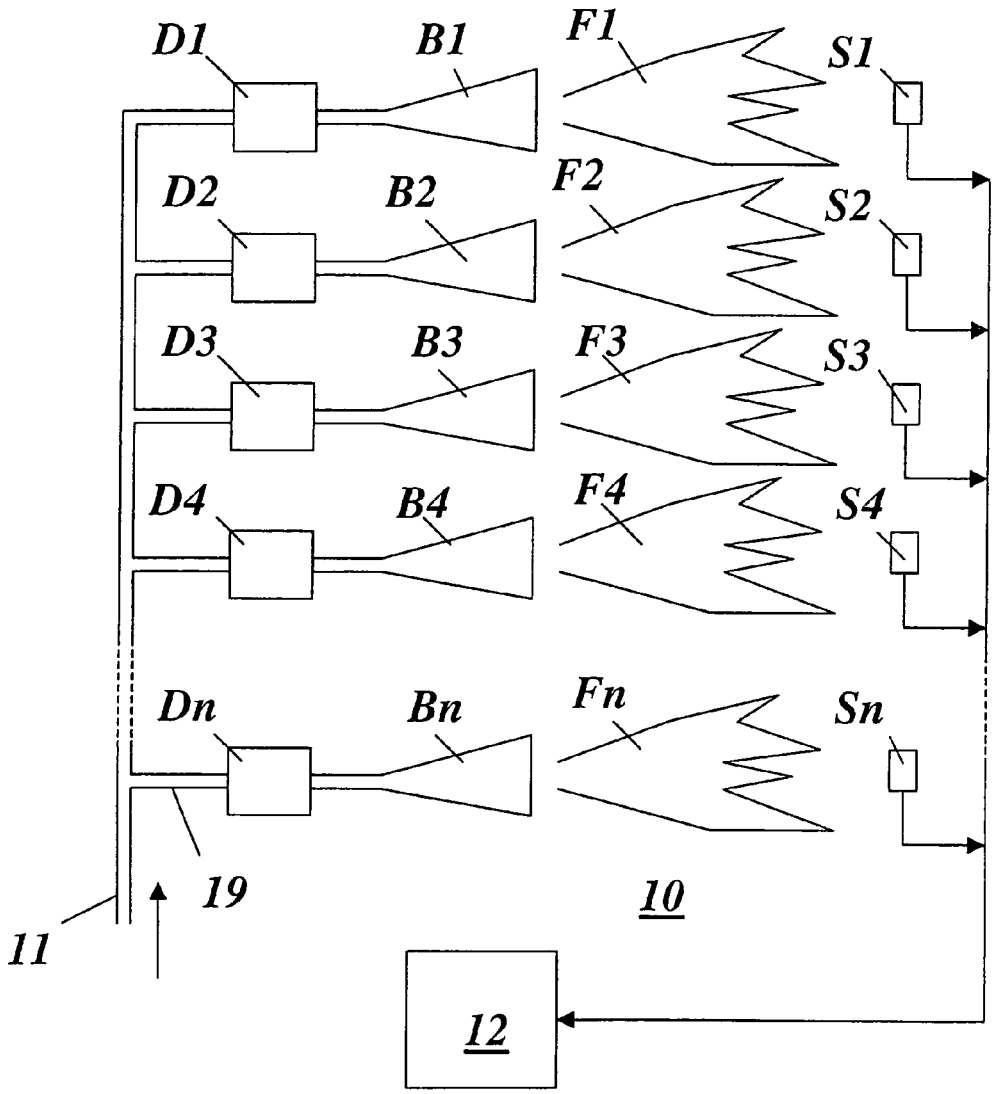
FIG. 1 shows a diagrammatic illustration of a burner arrangement in accordance with a preferred exemplary embodiment of the invention with direct measurement of the flame temperatures and throttling members in the fuel supply lines leading to the individual burners.

FIG. 1 diagrammatically depicts a burner arrangement in accordance with a preferred exemplary embodiment of the invention with direct measurement of the flame temperature. The burner arrangement 10 comprises a plurality (n; n=natural number) burners B1, . . . , Bn, which are arranged in a combustion chamber that is not shown (13 in FIG. 2) and can be operated in parallel. The burners (B1, . . . , Bn) are designed, for example, as double-cone burners, as shown and described inter alia in EP-A2-0 807 787. The individual burners B1, . . . , Bn are each connected via fuel feedlines 19 to a common fuel supply 11. The burners (B1, . . . , Bn) are usually arranged on one or more concentric circular rings. They may also be combined to form groups which are jointly supplied with fuel and operated.

In operation, each of the burners B1, . . . , Bn by combustion of the supplied liquid and/or gaseous fuel with the aid of compressed combustion air, generates a flame F1, . . . , Fn, the hot gases of which are then utilized for power engineering purposes in a downstream utilization device (turbine, steam generator etc.). On account of manufacturing and installation tolerances of burners and combustion chamber, the flames F1, . . . , Fn generated by the various burners B1, . . . , Bn in some cases have different flame temperatures, resulting in the presence of individual burners whose flame temperatures exceed a predetermined value. Although the mean value for the flame temperatures is within a tolerated range, the elevated temperatures of individual flames lead to high NOx emissions. In the exemplary embodiment shown in FIG. 1, a plurality of sensors S1, . . . , Sn are provided, which directly measure the temperatures of the individual flames F1, . . . , Fn by an optical route (e.g. spectral measurement). The sensors S1, . . . , Sn are connected to a measuring unit 12 in which the flame temperature measurements are evaluated and displayed. In particular, it is conceivable and advantageous to identify and indicate those burners whose flame temperature exceeds a predetermined value and is therefore too high.

If, following a flame temperature measurement of this type, selected burners are then indicated as operating at an excessively high flame temperature, these burners can be permanently corrected, with the result that the flame temperature of the corrected burner is reduced. This correction does not require any complex control devices, but rather can be carried out using relatively simple and operationally reliable means. In the exemplary embodiment shown in FIG. 1, throttling members D1, . . . , Dn which allow simple (partial) throttling of fuel supply to the respective burner are arranged in the fuel feedlines 19 leading to the burners B1, . . . , Bn.

Figure 4:
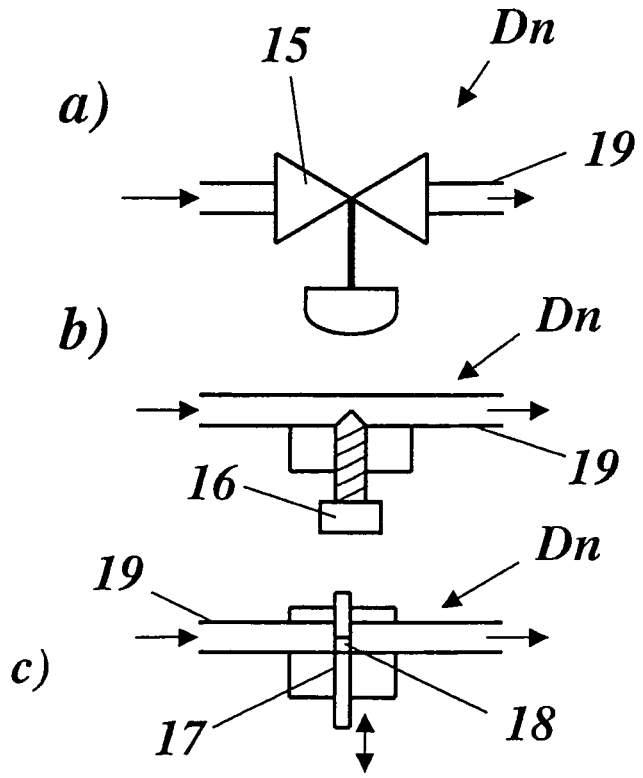
FIG. 4 shows a number of subfigures (FIGS. 4*a, b* and *c*) to show various types of throttling members which can be used to implement the invention.

An example of a selection of suitable throttling members Dn is illustrated in the partial figures (a) to (c) of FIG. 4. The throttling member Dn of FIG. 4*a* is designed as a settable valve 15. By partially closing the valve 15, it is possible to throttle the fuel supply in the associated fuel feedline 19 to the desired extent. FIG. 4*b* illustrates a throttling member Dn in the form of a throttling screw 16 which by being screwed in narrows the cross section of the fuel feedline 19 and thereby throttles the fuel supply. Finally, FIG. 4*c* shows a throttling member Dn in the form of a diaphragm 17 which has a diaphragm opening 18 with a cross section that is smaller than the cross section of the unthrottled fuel supply line 19. Different levels of throttling of the fuel supply can be achieved by installing different diaphragms 17 with different opening cross sections.

If, during the measurement of the flame temperatures, a burner with an excessively high flame temperature is identified, the supply of fuel to this burner is firstly throttled by a certain amount by means of the associated throttling member Dn. If the measurement is subsequently repeated and the excessively high flame temperature is still established, the throttling is boosted by a further step. This sequence can be repeated until the flame temperatures of all the burners B1, . . . , Bn are within a narrow tolerance range and have therefore been homogenized. The permanent throttling in steps ensures that it is impossible for any control oscillations to occur and that operation remains stable at any time. The use of simple throttling members keeps the costs low and leads to easy setting and a high operational reliability.

Figure 2:
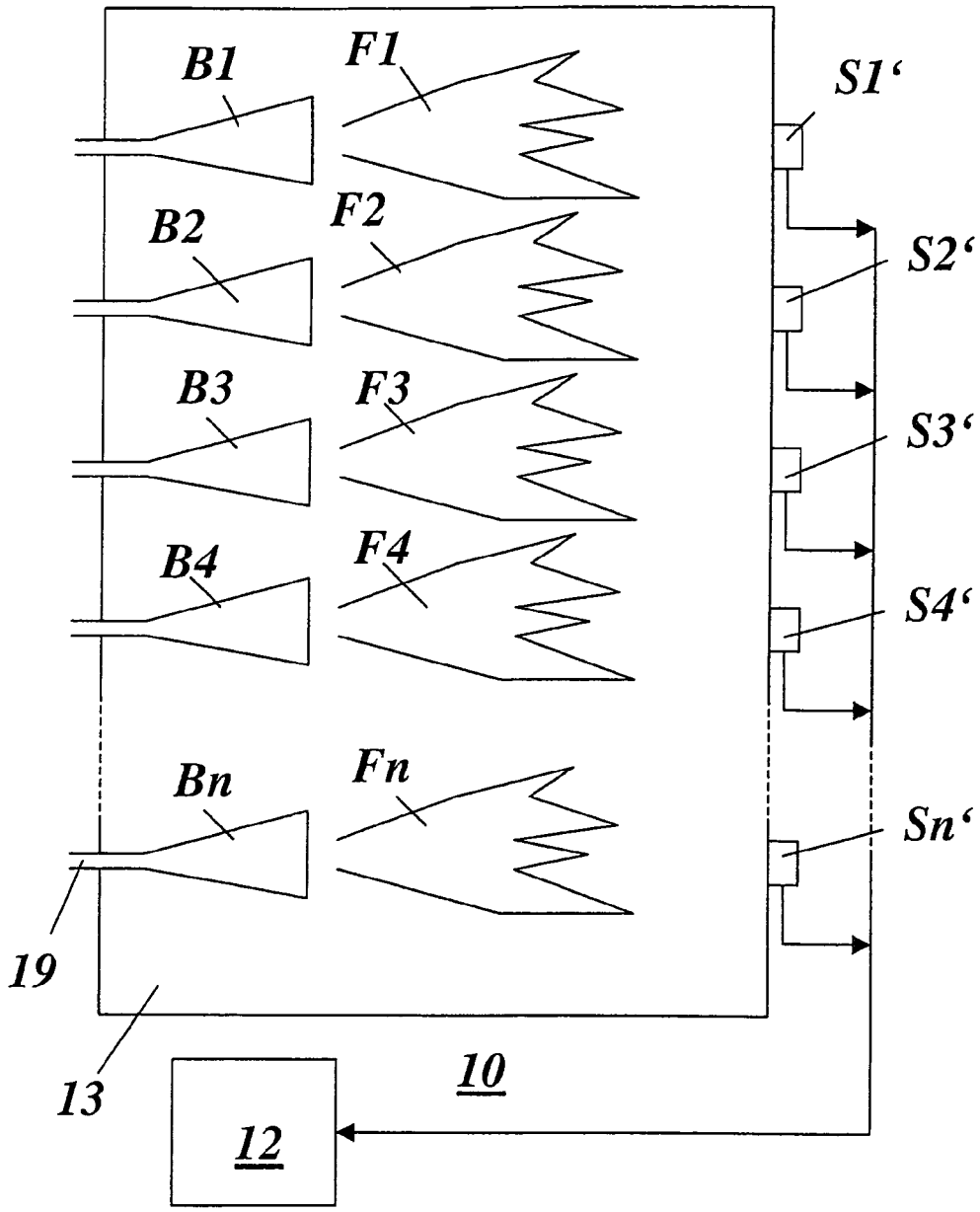
FIG. 2 shows an alternative exemplary embodiment of the invention to that shown in FIG. 1, in which the sensors for determining the flame temperatures are arranged on the combustion chamber and pick up material temperatures of combustion-chamber parts.

FIG. 2 shows a second exemplary embodiment of a burner arrangement according to the invention. The burners B1, . . . , Bn of the burner arrangement 10 are in this case illustrated together with the combustion chamber 13. The flames F1, . . . , Fn from the burners B1, . . . , Bn lead, at different flame temperatures, to different heating of components (walls etc.) in the combustion chamber 13. They can therefore be measured indirectly by measuring the temperature of certain components or regions of the combustion chamber 13 using appropriately fitted sensors S1', . . . , Sn' (thermocouples, resistance thermometers or the like). These sensors S1', . . . , Sn' are likewise connected to a measuring unit 12, so that the burners or burner groups to be throttled can be displayed in an identifiable way there. The throttling members themselves are not shown in FIG. 2, for the sake of simplicity.

Figure 3:
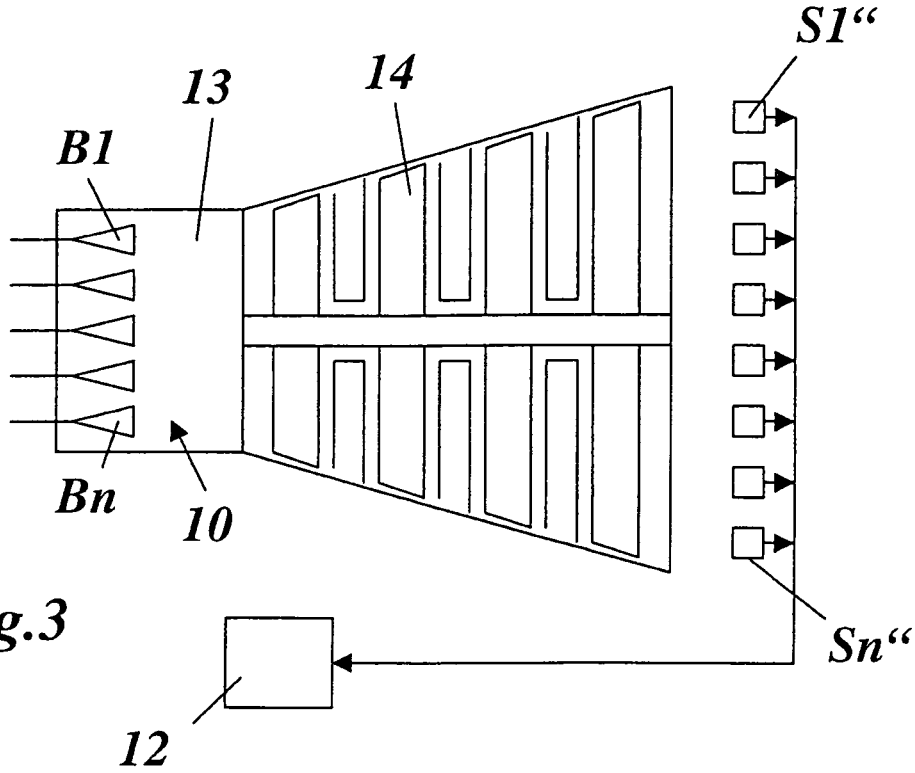
FIG. 3 shows an exemplary embodiment of the invention which represents an alternative to FIGS. 1 and 2 and in which the sensors are arranged at the outlet of a device for utilizing the combustion chamber gases, in the form of a gas turbine, and determine the flame temperatures from the temperature distribution at the outlet of a utilization device.

FIG. 3 illustrates a further exemplary embodiment of the invention. The combustion chamber 13 with the burners B1, . . . , Bn is in this case arranged on the inlet side of a utilization device, in this case a gas turbine 14. The hot gas generated by the burners B1, . . . , Bn flows through the turbine 14, performing work as it does so, and emerges at the outlet of the turbine 14, where a temperature distribution which is characteristic of the flame temperatures of the burners B1, . . . , Bn is established in the hot-gas stream. If this temperature distribution is measured by means of sensors S1", . . . , Sn", it is possible to ascertain the flame temperatures of the individual burners B1, . . . , Bn. Accordingly, it is possible to identify a burner with an excessively high flame temperature. The sensors S1", . . . , Sn" are likewise connected to a measuring unit 12. The throttling members for the fuel supply are not illustrated but are installed in the fuel feedlines in a similar way to that shown in FIG. 1.

Overall, the invention gives the following advantages:

- lowering of the maximum temperature in the combustion chamber, in particular of gas turbines;
- reduction of the NOx emissions, in particular from gas turbines;
- more uniform temperature distribution and therefore uniform thermal stressing of components;
- simple setting and simple installation;
- high operational reliability.

LIST OF DESIGNATIONS

10 burner arrangement
11 fuel supply
12 measuring unit
13 combustion chamber
14 turbine (gas turbine)
15 settable valve
16 throttling screw
17 diaphragm
18 diaphragm opening
19 fuel feedline
B1, . . . , Bn burner (e.g. double-cone burner)
D1, . . . , Dn throttling member
F1, . . . , Fn flame
S1, . . . , Sn sensors
S1', . . . , Sn' sensors
S1", . . . , Sn" sensors

The invention claimed is:

1. Method for reducing the NOx emissions from a burner arrangement comprising a plurality of burners, the burners in parallel, each burner supplied fuel and combustion air to form a flame, the method comprising a sequence of steps, each step including: measuring at a predetermined time an operating parameter of individual burners or burner groups or differences between the operating parameters of individual burners or burner groups wherein the operating parameter comprises a flame temperature of individual burners or burner groups; identifying burners or burner groups having a flame temperature that exceeds a predetermined temperature value; and throttling the fuel supply to those burners or burner groups whose flame temperature exceeds the predetermined value for the flame temperature to reduce the flame temperature by compensating for design-related and manufacturing-related deviations in these burners in order to homogenize the flame temperatures of the burners by adjusting an opening in a fuel feed line by an adjustable throttling screw arranged in the fuel feed line of each burner or burner groups.

2. The method as claimed in claim 1, comprising:

repeating the flame temperature measurement, identification of burners or burner groups, and subsequent throttling of the fuel supply to individual burners or burner groups one or more times until a predetermined degree of homogeneity of the flame temperatures has been achieved.

3. The method as claimed in claim 1, wherein the measurement of the flame temperatures is carried out directly at the flames.

4. The method as claimed in claim 3, wherein the measurement of the flame temperatures is carried out directly by an optical route.

5. The method as claimed in claim 1, further comprising providing means for measuring the flame temperatures of the individual burners or burner groups.

6. The method as claimed in claim 5, wherein the means for measuring comprises a plurality of sensors which are connected to a measuring unit.

7. The method as claimed in claim 6, wherein the sensors are designed for the direct measurement of the flame temperature, by an optical route.

8. The method as claimed in claim 6, wherein the sensors are designed to measure the temperature of components, in that the burners are accommodated in one or more combustion chambers, and in that the sensors are arranged to be distributed in or on the combustion chamber(s).

* * * * *